US007651041B2

(12) United States Patent
Wu

(10) Patent No.: US 7,651,041 B2
(45) Date of Patent: Jan. 26, 2010

(54) FOOD WASTE DISPOSER

(75) Inventor: Bao Tao Wu, Guangdong (CN)

(73) Assignee: Chiaphua Components Limited, Hong Kong (CN)

( * ) Notice: Subject to any disclaimer, the term of this patent is extended or adjusted under 35 U.S.C. 154(b) by 303 days.

(21) Appl. No.: 11/755,234

(22) Filed: May 30, 2007

(65) Prior Publication Data

US 2008/0296421 A1 Dec. 4, 2008

(51) Int. Cl.
*B02C 23/36* (2006.01)

(52) U.S. Cl. ..... 241/46.013

(58) Field of Classification Search ..... 241/46.013, 241/46.016, 296

See application file for complete search history.

(56) References Cited

U.S. PATENT DOCUMENTS 2,828,086 A 3/1958 Macemon
3,439,878 A 4/1969 Reaux
7,337,996 B2 * 3/2008 Hanson et al. ..... 241/46.013
2004/0173697 A1 9/2004 Berger et al.
2004/0245358 A1 12/2004 Jara-Almonte et al.
2005/0236502 A1 10/2005 Anderson et al.
2007/0131808 A1 * 6/2007 Anderson et al. ..... 241/46.013

FOREIGN PATENT DOCUMENTS

GB 648621 1/1951
GB 813304 5/1959

* cited by examiner

*Primary Examiner*—Faye Francis
(74) *Attorney, Agent, or Firm*—Leydig, Voit & Mayer, Ltd.

(57) ABSTRACT

Blades on a rotating grinding plate force waste against a stationary grinding ring. The blades are mounted on radially aligned guides on the grinding plate, allowing the blades to move freely inwardly and outwardly between opposing stops. The blades are thrown outward by rotation of the grinding plate. A receding face on the blades cooperates with the grinding ring for moving the blades inwardly and for forcing waste against the grinding ring.

14 Claims, 3 Drawing Sheets

FOOD WASTE DISPOSER

TECHNICAL FIELD

The present invention relates to apparatus for disintegrating food waste and particularly to such apparatus including a rotor to which blades are fixed.

BACKGROUND OF THE INVENTION

For use in a kitchen a waste disposer must be sufficiently versatile to satisfactorily process not just soft materials or viscous materials (such as fruit or cooked cereals) but also hard and tough materials (such as some vegetables and bones). Particularly in processing these latter materials the duration of grinding required is an important consideration in the design of a disposer.

Food waste in a conventional food waste disposer is forced by blades on a rotating grinding plate against teeth of a stationary grinding ring. Reduced processing times could be achieved if this action could be improved.

Additional time is also required, for example, if harder food fragments such as carrot and bone pieces rotate at the same speed as the grinding plate without being ground. This results in increased noise and vibration, as well as residual food left in the grinding chamber after the disposer is turned off. Over time, this residual food may cause unpleasant odours.

A further problem in designing a food waste disposer is jamming which occurs when hard objects such as bones enter the food waste disposer and get stuck between the blades of the rotating grinding plate and the stationary shredder ring.

It is an object of the present invention to overcome or substantially ameliorate the above disadvantages or more generally to provide an improved apparatus for disintegrating food waste.

DISCLOSURE OF THE INVENTION

According to one aspect of the present invention there is provided a food waste disposer comprising:

a waste receptacle having a base;

a grinding plate mounted at the base of the waste receptacle for rotation about an axis;

apertures in the grinding plate for the passage of waste;

at least one blade mounted to the grinding plate for travel toward and away from the axis;

a grinding ring about the periphery of the grinding plate for cooperating with the blade to disintegrate the waste, and inner and outer stop means engaging the blade at radially inner and outer travel limits of the blade respectively, the outer stop means engaging the blade as it is thrown outward by rotation of the grinding plate.

Preferably the blade is slidably engaged with guide means fixed to the grinding plate. The guide means preferably restrain the blade to move linearly, more preferably the guide means restrain the blade to move radially, most preferably the guide means restrain the blade to move radially parallel to a plane of the grinding plate.

Preferably the blade has at least one tooth having a leading face facing in a direction so as to confront materials to be disintegrated when the grinding plate is rotated, the leading face facing in the direction of rotation of the blade; a receding surface which extends away from the leading face in a direction directed outwardly from a tangent line, the receding surface having shear edges radially outward of the leading face for shearing waste.

The tooth preferably projects from the grinding plate substantially in the axial direction and includes a receding surface which extends away from the leading face in a direction directed axially outwardly from the leading face.

Preferably the guide means include upstands formed by stamping of the grinding plate. The blade preferably includes an elongate mounting portion extending in the radial direction from the tooth to an inner abutment, a saddle overlying the mounting portion and fixed to the grinding plate such that the abutment and tooth abut the saddle to limit the travel of the blade and provide the inner and outer stop means respectively.

Preferably two blades are mounted to the grinding plate for coaxial radial movement on opposing sides of the axis.

This invention provides a food waste disposer which is effective and efficient in operational use which, compared to comparable prior art disposers reduces processing times, especially for harder food fragments. The disposer is also less prone to jamming and moreover the device has an overall simple design which minimizes manufacturing costs and maximizes performance and reliability.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
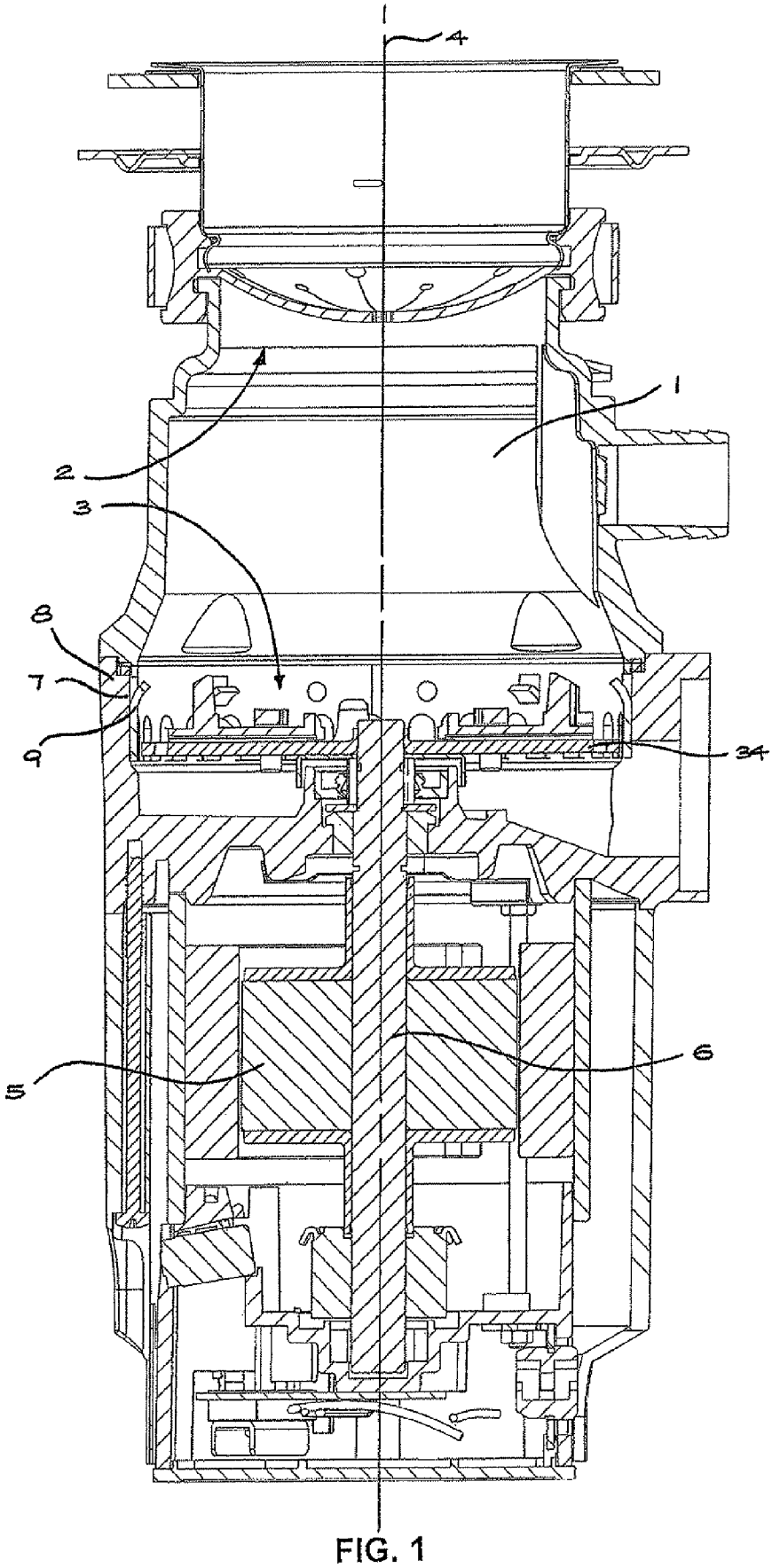
FIG. 1 is a schematic section in an upright plane through a food waste disposer of the present invention.

Referring to the drawings, particularly FIG. 1, a food waste disposer includes a grinding chamber 1 having an inlet 2 at its upper end and a grinding plate 3 mounted at its base. In use the plane of the grinding plate 3 is substantially horizontal and it is rotated about its upright central axis 4 by a motor/gearbox assembly 5 to which it is connected by a drive shaft 6. Adjacent the circular periphery 34 of the grinding plate 3 is grinding ring 7 fixed to the housing 8. The grinding ring 7 includes peripherally spaced teeth 9 which cooperate with the grinding plate 3 to disintegrate the waste.

Figure 2:
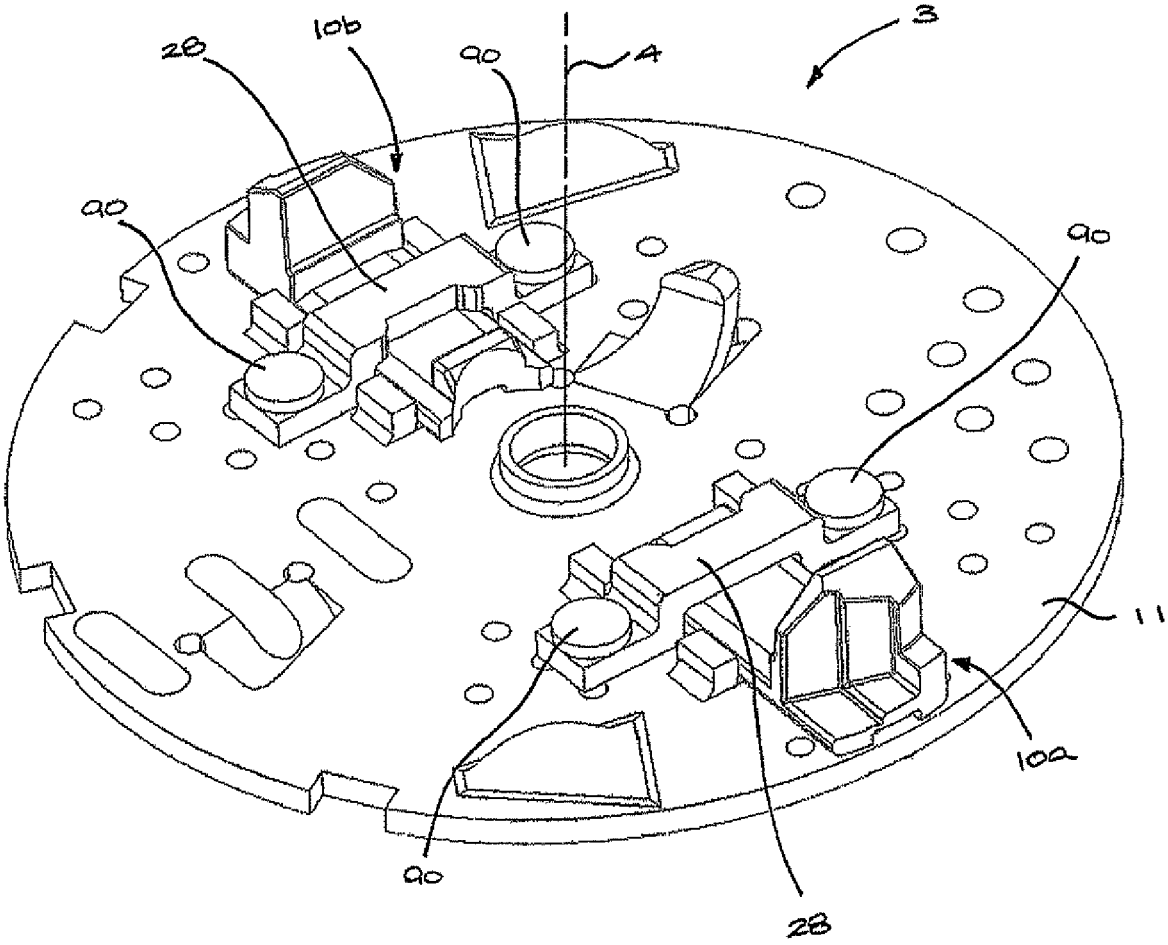
FIG. 2 is a pictorial view of the uppermost side of the grinding plate assembly of the disposer of FIG. 1.
Figure 3:
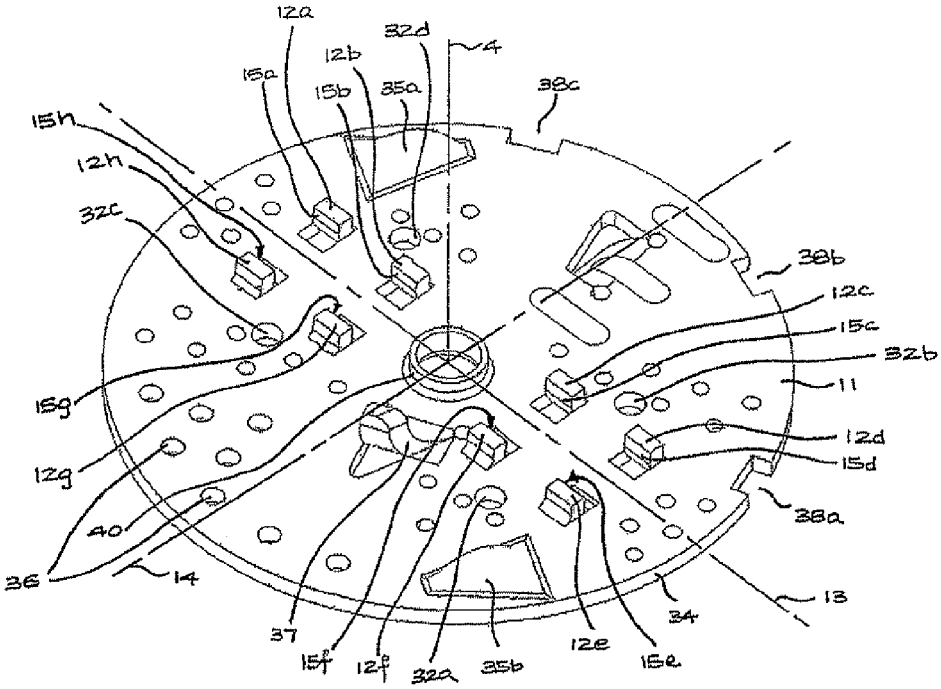
FIG. 3 is a pictorial view of the uppermost side: of the grinding plate of the assembly of FIG. 2.
Figure 4A:
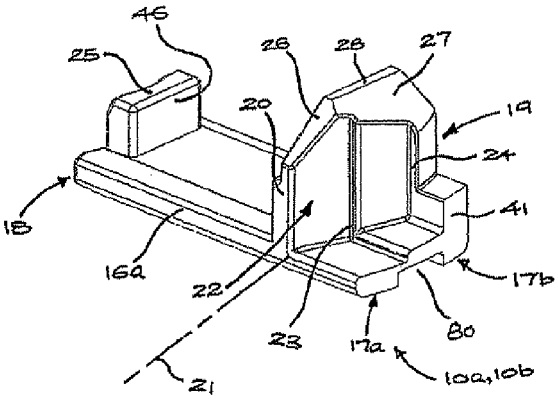
FIGS. 4*a* and 4*b* are pictorial views of a blade of the grinding plate of the assembly of FIG. 2.
Figure 4B:
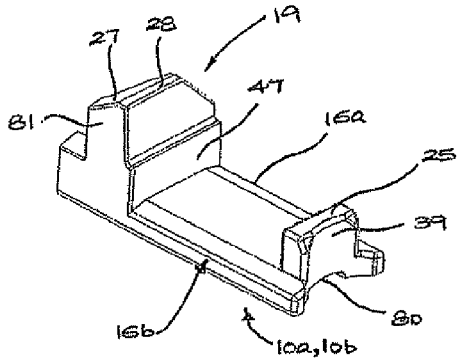
Figure 5:
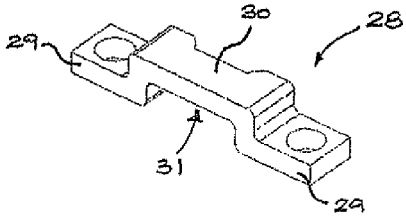
FIG. 5 is a pictorial view of a saddle of the grinding plate assembly of FIG. 2.
Figure 6:
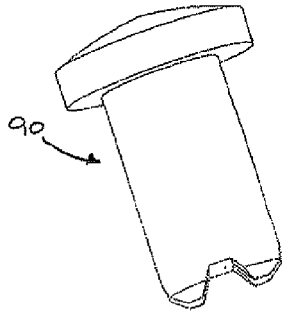
FIG. 6 is a pictorial view of a rivet for fastening the saddle.

As best seen in FIGS. 2 and 3, two like blades 10*a*, 10*b* are supported on the planar uppermost face 11 of the grinding plate 3, each mounted for linear travel toward and away from the axis 4 by upstands 12*a*-12*h* formed in the grinding plate 3 and one of the saddles 28.

The grinding plate 3 is a metal plate (for instance of stainless steel) and each of the upstands 12*a*-12*h* is formed by shearing and bending a section of the plate in a stamping operation. The upstands are arranged in two rows on either side of a radially-extending line 13 that bisects the grinding plate 3 and in sets of four symmetrically positioned either side of a line 14 bisecting the grinding plate perpendicular to line 13. Guide faces 15a-15d on each of the upstands 12a-12d are coplanar and parallel to the line 13 while respective opposing guide faces 15e-15h of the upstands 12e-12h offset to the other side of line 13 are also coplanar and parallel to the line 13.

Each of the blades 10a, 10b has an elongate mounting portion 18 extending in the radial direction and having parallel edges 16a, 16b that are received between the guide faces 15a-15h. A slot 80 parallel to the edges 16a, 16b in the base of the blades 10a, 10b reduces the contact area between the blades and the face 11, leaving the blades 10a, 10b supported upon coplanar support surfaces 17a, 17b. In this manner the blades 10a, 10b are restrained to move radially parallel to a plane of the grinding plate 3.

At the outer end of the mounting portion 18 a tooth 19 extends in the axial direction away from the face 11. The tooth 19 has a leading face 20 facing in the direction of rotation of the blade and aligned perpendicular to the tangent line 21 and to the support surfaces 17a, 17b so as to confront materials to be disintegrated when the grinding plate is rotated.

A receding surface 22 extends away from the leading face 20 to the trailing face 81 in a direction directed outwardly from the tangent line 21. The receding surface 22 is stepped, having first and second shear edges 24 radially outward of one another and of the leading face 20 for shearing waste.

The leading edge of the tooth 19 is chamfered to produce a planar chamfer face 26 extending away from the leading face 20 and inclined obliquely to the leading face 20 toward the axial end surface 28 on the axial tip of the tooth 19. The end surface 28 is planar and substantially parallel to the support surfaces 17a, 17b. Extending outwardly from the end surface 28 an upper oblique surface 27 is planar and inclined acutely to the end surface 28.

At the inner end of the mounting portion 18 an inner abutment nub 25 is formed, having an abutment face 46 on an outer side thereof. The abutment face 46 is positioned opposite an abutment face 27 formed on the tooth 19. At radially inner and outer ends of the blades 10a, 10b are arcuate surfaces 39, 41 respectively. The surface 39 is complementary to the cylindrical hub 40 and the surface 41 has the same radius of curvature as the peripheral edge 34.

A saddle 28 made, for instance, of corrosion-resistant steel has a symmetrical shape comprising parallel legs 29 joined by a web 30 to form a U-shape. The concave side 31 is complementary to the mounting portion 18 providing a sliding fit therebetween. The saddles 28 are permanently fixed to hold the blades 10a, 10b in place by rivets 90 extending through openings 32a-32d in the grinding plate 3. The nub 25 and tooth 19 provide stop means, the faces 46, 47 abutting the saddle 28 to limit the travel of the blades 10a, 10b.

Through-extending apertures 36 are provided in the grinding plate 3 for the passage of waste. Two protrusions 35a, 35b are formed in diametrically opposite positions in the plate by a stamping operation. The protrusions 35a, 35b have a smooth convex surface bounded by an irregular quadrilateral-shaped edge. A projecting lug 37 is formed in like manner to the upstands 12a-12h by shearing and bending a section of the plate in a stamping operation. Notches 38a-38c in the peripheral edge 34 provide additional cutting surfaces. The notches 38a-38c, lug 37 and protrusions 35a, 35b, like the blades 10a, 10b assist in breaking up the waste and driving it outwardly against the grinding ring 7.

When the grinding plate 3 is stationary the blades 10a, 10b are free to move radially, for instance, in response to water or waste being directed into the grinding chamber 1. In operation, rotation of the grinding plate 3 serves to throw the blades 10a, 10b outwardly, the nub 25 abutting the saddle 28 in a position where the arcuate surface 41 is radially aligned with the edge 34 adjacent the grinding ring 7. Material entering the tapering space between the receding face 22 and the grinding ring 9 tends to push the blade inwards, and in addition to the reaction forces acting to disintegrate the waste, clamping action may be provided, the blades holding the waste against the teeth 9 of the grinding ring 7.

Aspects of the present invention have been described by way of example only and it should be appreciated that modifications and additions may be made thereto without departing from the scope thereof.

The invention claimed is:

1. A food waste disposer comprising:

a waste receptacle having a base;

a grinding plate mounted at the base of the waste receptacle for rotation about an axis, the grinding plate having a periphery and apertures for the passage of waste;

a blade mounted to the grinding plate for travel toward and away from the axis;

guide means fixed to the grinding plate, wherein the blade is slidably engaged with the guide means;

a grinding ring about the periphery of the grinding plate for cooperating with the blade to disintegrate the waste, and inner and outer stop means engaging the blade at radially inner and outer travel limits of the blade, respectively, the outer stop means engaging the blade as the blade is thrown outward, away from the axis, by rotation of the grinding plate.

2. The food waste disposer of claim 1 wherein the guide means restrains the blade to move linearly.

3. The food waste disposer of claim 2 wherein the guide means restrains the blade to move radially.

4. The food waste disposer of claim 3 wherein the guide means restrains the blade to move parallel to the grinding plate.

5. The food waste disposer of claim 4 wherein the blade has at least one tooth having a leading face facing in a direction to confront materials to be disintegrated when the grinding plate is rotated, the leading face facing in a rotation direction of the blade, and a receding surface which extends away from the leading face in a direction directed outwardly with respect to a line tangent to the grinding plate, the receding surface having shear edges radially outward of the leading face for shearing waste.

6. The food waste disposer of claim 5 wherein the tooth projects from the grinding plate substantially in an axial direction and the receding surface extends away from the leading face in a direction directed axially outwardly from the leading face.

7. The food waste disposer of claim 6 wherein the guide means comprises upstands formed by stamping of the grinding plate.

8. The food waste disposer of claim 7 wherein the blade comprises an elongate mounting portion extending in a radial direction from the tooth to an inner abutment, and a saddle overlying the mounting portion and fixed to the grinding plate such that the abutment and tooth abut the saddle to limit the travel of the blade and provide the inner and outer stop means, respectively.

9. The food waste disposer of claim 8 including two blades mounted to the grinding plate for coaxial radial movement on opposing sides of the axis.

10. The food waste disposer of claim 4 including two blades mounted to the grinding plate for coaxial radial movement on opposing sides of the axis.

11. The food waste disposer of claim 1 wherein the blade has at least one tooth having a leading face facing in a direction to confront materials to be disintegrated when the grinding plate is rotated, the leading face facing in a rotation direction of the blade, and a receding surface which extends away from the leading face in a direction directed outwardly with respect to a line tangent to the grinding plate, the receding surface having shear edges radially outward of the leading face for shearing waste.

12. The food waste disposer of claim 11 wherein the tooth projects from the grinding plate substantially in an axial direction and the receding surface extends away from the leading face in a direction directed axially outwardly from the leading face.

13. The food waste disposer of claim 1 wherein the guide means comprises upstands formed by stamping of the grinding plate.

14. The food waste disposer of claim 1 including two blades mounted to the grinding plate for coaxial radial movement on opposing sides of the axis.

* * * * *